US010082013B2

(12) United States Patent
Nguyen et al.

(10) Patent No.: US 10,082,013 B2
(45) **Date of Patent: *Sep. 25, 2018**

(54) PROPPING COMPLEX FRACTURE NETWORKS IN TIGHT FORMATIONS

(71) Applicant: Halliburton Energy Services, Inc., Houston, TX (US)

(72) Inventors: Philip D. Nguyen, Duncan, OK (US); Jeff T. Fleming, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,179

(22) Filed: Nov. 21, 2017

(65) Prior Publication Data

US 2018/0073342 A1 Mar. 15, 2018

Related U.S. Application Data

(63) Continuation of application No. 13/459,478, filed on Apr. 30, 2012, now Pat. No. 9,850,748.

(51) Int. Cl.
*E21B 43/267* (2006.01)

(52) U.S. Cl.
CPC ..... *E21B 43/267* (2013.01)

(58) Field of Classification Search
USPC ..... 166/280.1
See application file for complete search history.

(56) References Cited

U.S. PATENT DOCUMENTS

| | | | | |
|---|---|---|---|---|
| 2,703,316 | A | 3/1955 | Schneider et al. | |
| 3,912,692 | A | 10/1975 | Casey et al. | |
| 3,937,283 | A | 2/1976 | Blauer et al. | |
| 4,078,609 | A * | 3/1978 | Pavlich | E21B 33/138 166/271 |
| 4,387,769 | A | 6/1983 | Erbstoesser et al. | |
| 4,512,405 | A | 4/1985 | Sweatman et al. | |
| 4,585,064 | A | 4/1986 | Graham et al. | |
| 4,670,501 | A | 6/1987 | Dymond et al. | |
| 5,216,050 | A | 6/1993 | Sinclair | |
| 5,249,627 | A | 10/1993 | Harms et al. | |
| 5,833,000 | A | 11/1998 | Weaver et al. | |

(Continued)

OTHER PUBLICATIONS

Buller et al., "Petrophysical Evaluation for Enhancing Hydraulic Stimulation in Horizontal Shale Gas Wells," Sep. 2010, SPE 132990, 21 pages.

(Continued)

*Primary Examiner* — Catherine Loikith
*Assistant Examiner* — Ashish K Varma
(74) *Attorney, Agent, or Firm* — McDermott Will & Emery LLP

(57) ABSTRACT

Generally, methods for propping complex fracture networks in tight subterranean formations may involve introducing a first treatment fluid comprising a first base fluid and a first propping agent having a mean particulate size distribution ranging from about 0.5 microns to about 20 microns into a fracture network in a subterranean formation; and then introducing a second treatment fluid comprising a second base fluid and a second propping agent having a mean particulate size distribution greater than about 35 microns into the fracture network.

30 Claims, 2 Drawing Sheets

(56) References Cited

U.S. PATENT DOCUMENTS

| | | | | |
|---|---|---|---|---|
| 5,839,510 | A | 11/1998 | Weaver et al. | |
| 5,853,048 | A | 12/1998 | Weaver et al. | |
| 5,905,061 | A | 5/1999 | Patel | |
| 5,964,289 | A * | 10/1999 | Hill | E21B 43/26 166/250.1 |
| 5,977,031 | A | 11/1999 | Patel | |
| 6,114,410 | A | 9/2000 | Betzold | |
| 6,311,773 | B1 | 11/2001 | Todd et al. | |
| 6,323,307 | B1 | 11/2001 | Bigg et al. | |
| 6,439,309 | B1 | 8/2002 | Matherly et al. | |
| 6,582,819 | B2 | 6/2003 | McDaniel et al. | |
| 6,677,426 | B2 | 1/2004 | Noro et al. | |
| 6,828,279 | B2 | 12/2004 | Patel et al. | |
| 7,032,664 | B2 | 4/2006 | Lord et al. | |
| 7,153,575 | B2 | 12/2006 | Anderson et al. | |
| 7,210,528 | B1 * | 5/2007 | Brannon | C09K 8/62 507/140 |
| 7,213,651 | B2 * | 5/2007 | Brannon | C09K 8/62 166/177.5 |
| 7,735,551 | B2 | 6/2010 | Vozniak et al. | |
| 8,607,870 | B2 | 12/2013 | Gu et al. | |
| 8,613,314 | B2 | 12/2013 | Garcia-Lopez De Victoria et al. | |
| 2002/0007949 | A1 | 1/2002 | Tolman et al. | |
| 2005/0274517 | A1 | 12/2005 | Blauch et al. | |
| 2005/0274523 | A1 | 12/2005 | Brannon et al. | |
| 2005/0277554 | A1 | 12/2005 | Blauch et al. | |
| 2006/0048944 | A1 | 3/2006 | van Batenburg et al. | |
| 2006/0289160 | A1 * | 12/2006 | van Batenburg | C09K 8/80 166/280.2 |
| 2007/0131422 | A1 | 6/2007 | Gatlin et al. | |
| 2007/0131425 | A1 | 6/2007 | Gatlin et al. | |
| 2007/0161422 | A1 | 7/2007 | Behnke et al. | |
| 2008/0006405 | A1 | 1/2008 | Rickman et al. | |
| 2011/0083849 | A1 | 4/2011 | Medvedev et al. | |
| 2011/0180259 | A1 | 7/2011 | Willberg et al. | |
| 2011/0192601 | A1 | 8/2011 | Bahorich et al. | |
| 2011/0272159 | A1 | 11/2011 | Osiptsov et al. | |
| 2012/0125617 | A1 | 5/2012 | Gu et al. | |
| 2013/0105166 | A1 * | 5/2013 | Medvedev | E21B 21/062 166/308.1 |
| 2013/0284437 | A1 | 10/2013 | Nguyen et al. | |
| 2014/0262291 | A1 | 9/2014 | Chen et al. | |

OTHER PUBLICATIONS

Cipolla et al., "The Relationship Between Fracture Complexity, Reservior Properties and Fracture-Treatment Design," Dec. 2010, SPE 115769, 21 pages.

Craig et al., "Case History: Observations Fron Diagnostic Injection Tests in Multiple Pay Sands of the Mamm Creek Field, Piceance Basin, Colorado," Mar. 2000, SPE 60321, 10 pages.

* cited by examiner

PROPPING COMPLEX FRACTURE NETWORKS IN TIGHT FORMATIONS

BACKGROUND

The present invention relates to methods for propping complex fracture networks in tight subterranean formations.

After a wellbore is drilled, it may often be necessary to fracture the subterranean formation to enhance hydrocarbon production, especially in tight formations like shales and tight-gas sands. Access to the subterranean formation can be achieved by first creating an access conduit, such as a perforation, from the wellbore to the subterranean formation. Then, a fracturing fluid, often called a pad fluid, is introduced at pressures exceeding those required to maintain matrix flow in the formation permeability to create or enhance at least one fracture that propagates from at least one access conduit. The pad fluid is followed by a treatment fluid comprising a propping agent to prop the fracture open after pressure from the fluid is reduced. In some formations like shales, fractures can further branch into small fractures extending from a primary fracture giving depth and breadth to the fracture network created in the subterranean formation. As used herein, a "fracture network" refers to the access conduits, fractures, microfractures, and/or branches, man-made or otherwise, within a subterranean formation that are in fluid communication with the wellbore. As used herein, an "access conduit" refers to a passageway that provides fluid communication between the wellbore and the subterranean formation, which may include, but not be limited to, sliding sleeves, open holes in non-cased areas, hydrajetted holes, holes in the casing, perforations, and the like. The propping agents hold open the fracture network thereby maintaining the ability for fluid to flow through the fracture network to ultimately be produced at the surface.

In tight formations, especially those with high closure stresses, the size of the microfractures is often smaller than traditional propping agents. Therefore, once the fluid pressure is released the propping agent primarily maintains the fractures and branches of the fracture network while many of the microfractures close. In tight formations where microfractures are prevalent, this closure can significantly reduce the potential hydrocarbon material that can be produced from the subterranean formation before another fracturing and propping operation needs to be performed again, which can be expensive and time consuming.

SUMMARY OF THE INVENTION

The present invention relates to methods for propping complex fracture networks in tight subterranean formations.

Some embodiments of the present invention involve introducing a first treatment fluid comprising a first base fluid and a first propping agent having a mean particulate size distribution ranging from about 0.5 microns to about 20 microns into a fracture network in a subterranean formation; and then introducing a second treatment fluid comprising a second base fluid and a second propping agent having a mean particulate size distribution greater than about 35 microns into the fracture network.

Other embodiments of the present invention involve, in order, isolating a first zone extending from a wellbore in a subterranean formation, the first zone comprising a first fracture network; introducing a first treatment fluid comprising a first base fluid and a first propping agent having a mean particulate size distribution ranging from about 0.5 microns to about 20 microns into the first fracture network; introducing a second treatment fluid comprising a second base fluid and a second propping agent having a mean particulate size distribution greater than about 35 microns into the first fracture network; isolating a second zone extending from the wellbore in the subterranean formation, the second zone comprising a second fracture network; introducing a third treatment fluid comprising a third base fluid and a third propping agent having a mean particulate size distribution ranging from about 0.5 microns to about 20 microns into the second fracture network; and introducing a fourth treatment fluid comprising a fourth base fluid and a fourth propping agent having a mean particulate size distribution greater than about 35 microns into the second fracture network.

Yet other embodiments of the present invention involve, in order, isolating a first zone extending from a wellbore in a subterranean formation; introducing a first treatment fluid into the first zone of the subterranean formation at a pressure sufficient to create or extend at least a portion of a first fracture network in the first zone; introducing a second treatment fluid comprising a first base fluid and a first propping agent having a mean particulate size distribution ranging from about 0.5 microns to about 20 microns into the first fracture network; and introducing a third treatment fluid comprising a second base fluid and a second propping agent having a mean particulate size distribution greater than about 35 microns into the first fracture network.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
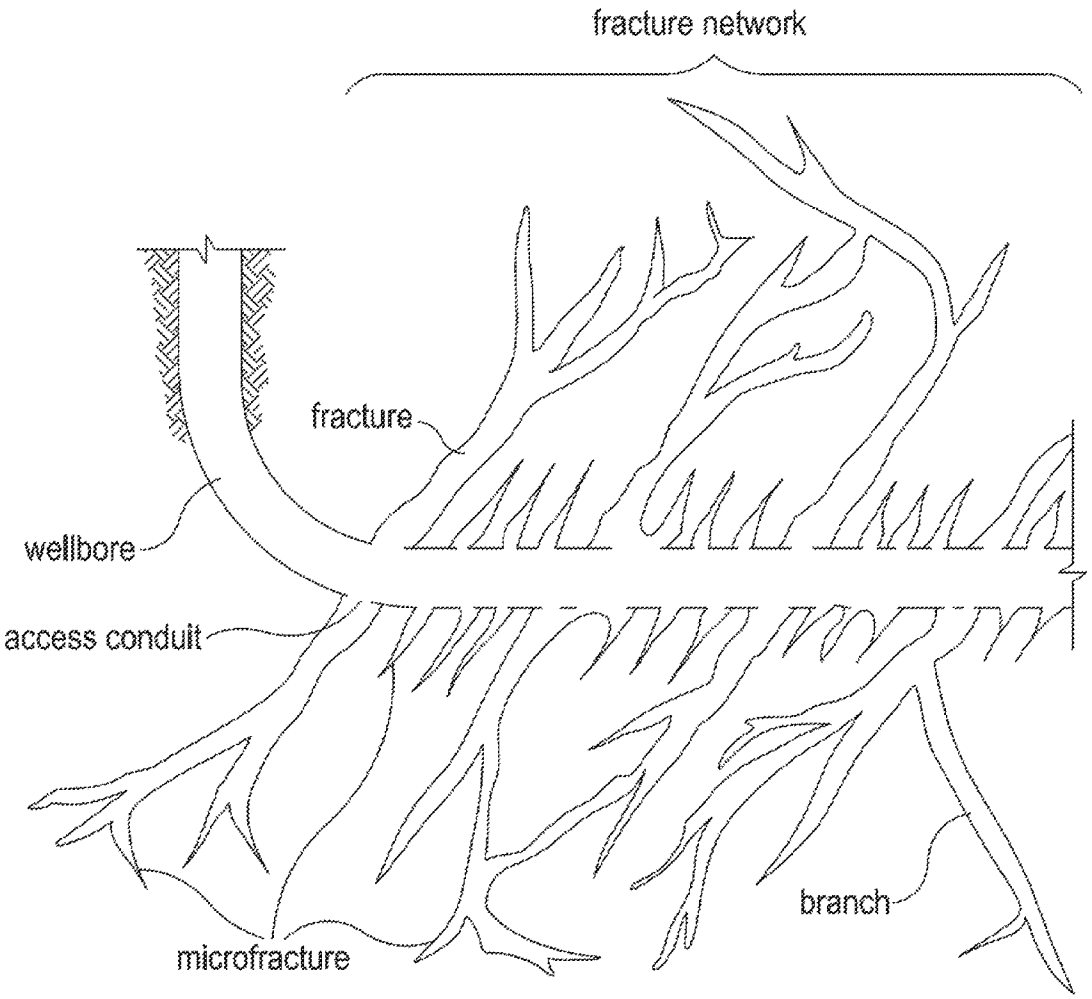
FIG. 1 illustrates a nonlimiting example of a dendritic fracture network extending from a wellbore into a subterranean formation.

The present invention relates to methods for propping complex fracture networks in tight subterranean formations.

The methods of the present invention may, in some embodiments, advantageously provide for propping the various portions of complex fracture networks (e.g., the fractures, branches, and microfractures) in tight formations (e.g., shales and tight-gas sands). In some embodiments, the methods of the present invention provide for staged propping operations that target propping the microfractures with small propping agents first followed by the larger fractures and branches with large propping agents. Propping microfractures of tight formations may advantageously enhance the amount of hydrocarbon that can be produced from a subterranean formation after a fracturing and propping operation, thereby reducing the time and cost associated with producing hydrocarbons from tight formations.

For clarity and simplicity, as used herein, the term "small propping agents" refers to propping agents having a mean particulate size distribution ranging from about 0.5 microns to about 20 microns, or any subset therebetween (e.g., about 1 micron to about 10 microns). Further as used herein, the term "large propping agents" refers to propping agents having a particulate size distribution ranging from a lower limit of about 35 microns, 50 microns, 100 microns, or 200 microns to an upper limit of about 800 microns, 750 microns, 500 microns, or 250 microns, or any subset therebetween (e.g., about 75 microns to about 650 microns). It should be noted the descriptive terms "small" and "large" are used for clarity in this disclosure and should not themselves be read as limiting.

Further, the methods of the present invention generally provide for introduction of large propping agents after small propping agents, which may advantageously provide a proppant pack of the large propping agents that can mitigate or prevent the flow back of small propping agents into the wellbore. In some embodiments, the large propping agents and/or small propping agents may have a coating that further assists with prevention of small propping agent flow back. Details of the coating are described further herein.

It should be noted that when "about" is provided at the beginning of a numerical list, "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

As used herein, "propping agents" refers to any material or formulation that can be used to hold open at least a portion of a fracture network. Nonlimiting examples of propping agents are provided herein. As used herein, a "proppant pack" is the collection of propping agents in a fracture network. It should be understood that the term "particulate" or "particle," and derivatives thereof as used in this disclosure, includes all known shapes of materials, including substantially spherical materials, low to high aspect ratio materials, fibrous materials, polygonal materials (such as cubic materials), and mixtures thereof.

Figure 2:
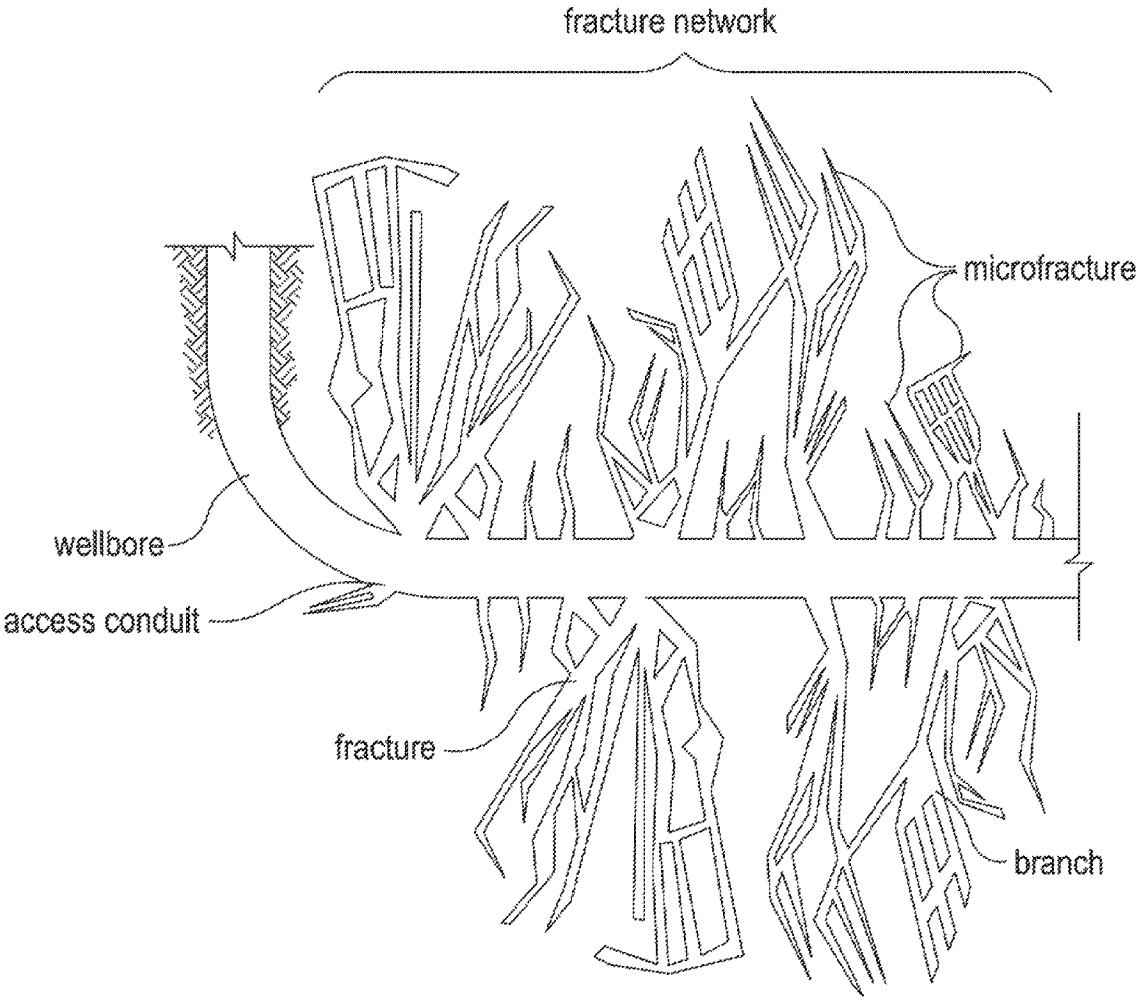
FIG. 2 illustrates a nonlimiting example of a shattered fracture network extending from a wellbore into a subterranean formation.

As noted above, a "fracture network," as used herein, refers to the access conduits, fractures, microfractures, and/or branches, man-made or otherwise, within a subterranean formation that are in fluid communication with the wellbore. In some embodiments, a fracture network may be considered a dendritic fracture network, a shattered fracture network, or any combination thereof. FIG. 1 illustrates a nonlimiting example of a dendritic fracture network extending from a wellbore into a subterranean formation. FIG. 2 illustrates a nonlimiting example of a shattered fracture network extending from a wellbore into a subterranean formation. These nonlimiting examples illustrate two common types of fracture networks extending from a horizontal well. It should be understood that the methods provided herein are applicable to wellbores at any angle including, but not limited to, vertical wells, deviated wells, highly deviated wells, horizontal wells, and hybrid wells comprising sections of any combination of the aforementioned wells. In some embodiments, a subterranean formation and wellbore may be provided with an existing fracture network. As used herein, the term "deviated wellbore" refers to a wellbore in which any portion of the well is that is oriented between about 55-degrees and about 125-degrees from a vertical inclination. As used herein, the term "highly deviated wellbore" refers to a wellbore that is oriented between about 75-degrees and about 105-degrees off-vertical.

The methods of the present invention may be used in any subterranean formation capable of being fractured. Formations where the present methods may be most advantageous include, but are not limited to, formations with at least a portion of the formation characterized by very low permeability, very low formation pore throat size, high closure pressures, high brittleness index, and any combination thereof.

In some embodiments, at least a portion of a subterranean formation may have a permeability ranging from a lower limit of about 0.1 nano Darcy (nD), 1 nD, 10 nD, 25 nD, 50 nD, 100 nD, or 500 nD to an upper limit of about 10 mD, 1 mD, 500 microD, 100 microD, 10 microD, or 500 nD, and wherein the permeability may range from any lower limit to any upper limit and encompass any subset therebetween. One method to determine the subterranean formation permeability includes The American Petroleum Institute Recommended Practice 40, "Recommended Practices for Core Analysis," Second Edition, February 1998.

In some embodiments, at least a portion of a subterranean formation may have an average formation pore throat size ranging from a lower limit of about 0.005 microns, 0.01 microns, 0.05 microns, 0.1 microns, 0.25 microns, or 0.5 microns to an upper limit of about 2.0 microns, 1.5 microns, 1.0 microns, or 0.5 microns, and wherein the average formation pore throat size may range from any lower limit to any upper limit and encompass any subset therebetween. One method to determine the pore throat size of a subterranean formation includes the AAPG Bulletin, March 2009, v. 93, no. 3, pages 329-340.

In some embodiments, at least a portion of a subterranean formation may have a closure pressure greater than about 500 psi to an unlimited upper limit. While the closure pressure upper limit is believed to be unlimited, formations where the methods of the present invention may be applicable include formations with a closure pressure ranging from a lower limit of about 500 psi, 1000 psi, 1500 psi, or 2500 psi to an upper limit of about 20,000 psi, 15,000 psi, 10,000 psi, 8500 psi, or 5000 psi, and wherein the closure pressure may range from any lower limit to any upper limit and encompass any subset therebetween. One method to determine the subterranean formation closure pressure includes the method presented in the Society for Petroleum Engineers paper number 60321 entitled "Case History: Observations From Diagnostic Injection Tests in Multiple Pay Sands of the Mamm Creek Field, Piceance Basin, Colo."

In some embodiments, at least a portion of a subterranean formation may have a brittleness index ranging from a lower limit of about 5, 10, 20, 30, 40, or 50 to an upper limit of about 150, 125, 100, or 75, and wherein the brittleness index may range from any lower limit to any upper limit and encompass any subset therebetween. Brittleness is a composite of Poisson's ratio and Young's modulus. One method to determine the brittleness index of a subterranean formation includes the method presented in the Society for Petroleum Engineers paper number 132990 entitled "Petrophysical Evaluation of Enhancing Hydraulic Stimulation in Horizontal Shale Gas Wells."

In certain embodiments, all or part of a wellbore penetrating the subterranean formation may include casing pipes or strings placed in the wellbore (a "cased hole" or a "partially cased hole"), among other purposes, to facilitate production of fluids out of the formation and through the wellbore to the surface. In other embodiments, the wellbore may be an "open hole" that has no casing.

In some embodiments, the methods disclosed herein may be used in conjunction with zipper fracture techniques. Zipper fracture techniques use pressurized fracture networks in at least one wellbore to direct the fracture network of a second, nearby wellbore. Because the first fracture network is pressurized and exerting a stress on the subterranean formation, the second pressure network may extend through the path of least resistance, i.e., the portions of the subterranean formation under less stress. Continuing to hold open portions of the fracture network with propping agent may continue to provide stress on the subterranean formation even with a reduced fluid pressure therein. Therefore, enhancing the propping of more of the fracture network including microfractures may enhance efficacy of a zipper fracture technique. In some embodiments, any of the methods described herein may be implemented in at least one wellbore to enhance a proximal fracture network of at least one nearby wellbore. As used herein the term "proximal" when referring to multiple fracture networks refers to fracture networks in close enough proximity that the formation stresses caused by propping one of the fracture networks impact the structure of a second fracture network.

It should be noted that when "about" is provided at the beginning of a numerical list, "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

Generally methods of the present invention may, in some embodiments, involve the steps of:

(a) introducing a first treatment fluid comprising a first propping agent having a mean particulate size distribution ranging from about 0.5 microns to about 20 microns (i.e., small propping agents) into a fracture network of at least one zone of the subterranean formation; and then, (b) introducing a second treatment fluid comprising a second propping agent having a particulate size distribution ranging from about 35 microns to about 200 microns (i.e., large propping agents) into at least a portion of the fracture network.

In some embodiments, the first treatment fluid and/or the second treatment fluid may be introduced at a pressure sufficient to create or extend at least a portion of a fracture network in the zone of the subterranean formation. It should be noted that the terms "first" and "second" are used herein for clarity and distinction between similar terms and should not be read as limiting. When steps are to be performed in a specific order, terms such as "then," "before," "next," "subsequent," and "in order" are used.

Optionally, methods of the present invention may, in some embodiments, involve additional steps including, but not limited to, (c) isolating a zone of a subterranean formation;

(d) introducing a third treatment fluid before the first treatment fluid, where the third treatment fluid does not comprise propping agents, and where the third treatment fluid may, in some embodiments, be introduced at a pressure sufficient to create or extend at least a portion of a fracture network; and/or (e) producing hydrocarbons from at least one zone of the subterranean formation.

Further, some embodiments may involve repeating at least one of steps (a), (b), (c), or (d) at least one time. By way of nonlimiting example, some embodiments of the present invention may involve at least the steps of (in order):

(c1) isolating a first zone of a subterranean formation;

(a1) introducing a first treatment fluid comprising first small propping agents into the first zone of the subterranean formation at a pressure sufficient to create or extend at least a portion of a first fracture network in the first zone of the subterranean formation;

(b1) introducing a second treatment fluid comprising first large propping agents into at least a portion of the first fracture network;

(c2) isolating a second zone of a subterranean formation;

(a2) introducing a third treatment fluid comprising second small propping agents into the second zone of the subterranean formation at a pressure sufficient to create or extend at least a portion of a second fracture network in the second zone of the subterranean formation; and (b2) introducing a fourth treatment fluid comprising second large propping agents into at least a portion of the second fracture network.

In some embodiments, the first and second fracture networks may be connected.

By way of another nonlimiting example, some embodiments of the present invention may involve at least the steps of (in order):

(c1) isolating a first zone of a subterranean formation;

(d1) introducing a first treatment fluid into the first zone of the subterranean formation at a pressure sufficient to create or extend at least a portion of a first fracture network in the first zone of the subterranean formation;

(a1) introducing a second treatment fluid comprising first small propping agents into the first fracture network;

(b1) introducing a third treatment fluid comprising first large propping agents into the first fracture network;

(c2) isolating a second zone of a subterranean formation;

(a2) introducing a fourth treatment fluid comprising second small propping agents into the second zone of the subterranean formation at a pressure sufficient to create or extend at least a portion of a second fracture network in the second zone of the subterranean formation;

(b2) introducing a fifth treatment fluid comprising second large propping agents into at least a portion of the second fracture network;

(c3) isolating a third zone of a subterranean formation;

(d3) introducing a sixth treatment fluid into the third zone of the subterranean formation at a pressure sufficient to create or extend at least a portion of a third fracture network in the third zone of the subterranean formation;

(a3) introducing a seventh treatment fluid comprising third small propping agents into the third fracture network;

(b3) introducing an eighth treatment fluid comprising third large propping agents into the third fracture network; and (e1) producing hydrocarbons from at least one zone of the subterranean formation.

In some embodiments, a zone of the subterranean formation comprising a fracture network may be treated multiple times with small and large propping agents, alternating between introducing small and large propping agents into the fracture network. By way of yet another nonlimiting example, some embodiments of the present invention may involve at least the steps of (in order):

(c1) isolating a zone of a subterranean formation;

(d1) introducing a first treatment fluid into the zone of the subterranean formation at a pressure sufficient to create or extend at least a portion of a fracture network in the first zone of the subterranean formation;

(a1) introducing a second treatment fluid comprising first small propping agents into the fracture network;

(b1) introducing a third treatment fluid comprising first large propping agents into the fracture network;

(a2) introducing a fourth treatment fluid comprising second small propping agents into the fracture network;

(b2) introducing a fifth treatment fluid comprising second large propping agents into the fracture network;

(a3) introducing a sixth treatment fluid comprising third small propping agents into the fracture network;

(b3) introducing a seventh treatment fluid comprising third large propping agents into the fracture network; and (e1) producing hydrocarbons from at least one zone of the subterranean formation.

It should be understood by one skilled in the art with the benefit of this disclosure that hybrids of any of the aforementioned nonlimiting examples or embodiments are within the scope of the present invention. For example, multiple zones may be treated within a subterranean formation, where each zone may independently receive multiple treatments of small and large propping agents.

In some embodiments, treatment fluids introduced after a fracture network is created or extended may be introduced into the fracture network at either a pressure sufficient to at least maintain the fracture network or at a pressure sufficient to create or extend the fracture network.

Suitable methods or steps of a method of isolating a zone of a subterranean formation may include, but are not limited to, inserting a packer into the wellbore, inserting a bridge plug into the wellbore, inserting diverting agents into the wellbore and/or fracture network, inserting perf balls into the wellbore and/or fracture network, or any combination thereof so as to divert fluid to the desired isolated zone of the subterranean formation.

In some embodiments, the treatment fluids used in conjunction with the present invention may be produced at the well site, and in some embodiments on-the-fly. Suitable methods for producing treatment fluids at the well site or on-the-fly should be known to those skilled in the art. By way of nonlimiting example, in some embodiments, the small propping agents and/or large propping agents may be part of a slurry that can be atomized into a treatment fluid flow stream, base fluid flow stream, or any other suitable fluid flow stream. In some embodiments, atomization into the treatment fluid flow stream, base fluid flow stream, or any other suitable fluid flow stream may be during introduction of the treatment fluid into the subterranean formation, i.e., an example of on-the-fly treatment fluid preparation. Such a procedure may advantageous provide for safer handling of the small propping agents because the size of the small propping agents lend themselves to static charging and dust explosions. In some embodiments, small propping agents may be delivered to the well site as part of a slurry.

Suitable small propping agents and/or large propping agents may comprise a plurality of proppant particulates. Proppant particulates suitable for use in the present invention may comprise any material suitable for use in subterranean operations. Suitable materials for these proppant particulates include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Suitable proppant particles of small propping agents and/or large propping agents for use in conjunction with the present invention may be any known shape of material, including substantially spherical materials, fibrous materials, polygonal materials (such as cubic materials), and combinations thereof. Moreover, fibrous materials, that may or may not be used to bear the pressure of a closed fracture, may be included in certain embodiments of the present invention.

In some embodiments, small propping agents and/or large propping agents may be present in a treatment fluid for use in the present invention in an amount in the range of from about 0.1 pounds per gallon ("ppg") to about 12 ppg by volume of the treatment fluid.

In some embodiments, large propping agents may comprise degradable materials. Degradable materials may include, but not be limited to, dissolvable materials, materials that deform or melt upon heating such as thermoplastic materials, hydrolytically degradable materials, materials degradable by exposure to radiation, materials reactive to acidic fluids, or any combination thereof. In some embodiments, degradable materials may be degraded by temperature, presence of moisture, oxygen, microorganisms, enzymes, pH, free radicals, and the like. In some embodiments, degradation may be initiated in a subsequent treatment fluid introduced into the subterranean formation. In some embodiments, degradation may be initiated by a delayed-release acid, such as an acid-releasing degradable material or an encapsulated acid, and this may be included in the treatment fluid comprising the degradable material so as to reduce the pH of the treatment fluid at a desired time, for example, after introduction of the treatment fluid into the subterranean formation.

In choosing the appropriate degradable material, one should consider the degradation products that will result. Also, these degradation products should not adversely affect other operations or components. For example, a boric acid derivative may not be included as a degradable material in the well drill-in and servicing fluids of the present invention where such fluids use guar as the viscosifier, because boric acid and guar are generally incompatible. One of ordinary skill in the art, with the benefit of this disclosure, will be able to recognize when potential components of a treatment fluid of the present invention would be incompatible or would produce degradation products that would adversely affect other operations or components.

The degradability of a degradable polymer often depends, at least in part, on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Suitable examples of degradable polymers for a solid particulate of the present invention that may be used include, but are not limited to, polysaccharides such as cellulose; chitin; chitosan; and proteins. Specific examples include homopolymers, random, block, graft, and star- and hyper-branched aliphatic polyesters. Such suitable polymers may be prepared by polycondensation reactions, ring-opening polymerizations, free radical polymerizations, anionic polymerizations, carbocationic polymerizations, coordinative ring-opening polymerizations, as well as by any other suitable process. Examples of suitable degradable polymers that may be used in conjunction with the methods of this invention include, but are not limited to, aliphatic polyesters; poly(lactides); poly(glycolides); poly(ε-caprolactones); poly (hydroxy ester ethers); poly(hydroxybutyrates); poly(anhydrides); polycarbonates; poly(orthoesters); poly(amino acids); poly(ethylene oxides); poly(phosphazenes); poly (ether esters), polyester amides, polyamides, and copolymers or blends of any of these degradable polymers, and derivatives of these degradable polymers. The term "copolymer" as used herein is not limited to the combination of two polymers, but includes any combination of polymers, e.g., terpolymers and the like. As referred to herein, the term "derivative" is defined herein to include any compound that is made from one of the listed compounds, for example, by replacing one atom in the base compound with another atom or group of atoms. Of these suitable polymers, aliphatic polyesters such as poly(lactic acid), poly(anhydrides), poly (orthoesters), and poly(lactide)-co-poly(glycolide) copolymers are preferred. Poly(lactic acid) is especially preferred. Poly(orthoesters) also may be preferred. Other degradable polymers that are subject to hydrolytic degradation also may be suitable. One's choice may depend on the particular application and the conditions involved. Other guidelines to consider include the degradation products that result, the time required for the requisite degree of degradation, and the desired result of the degradation (e.g., voids).

Aliphatic polyesters degrade chemically, inter alia, by hydrolytic cleavage. Hydrolysis can be catalyzed by either acids or bases. Generally, during the hydrolysis, carboxylic end groups may be formed during chain scission, which may enhance the rate of further hydrolysis. This mechanism is known in the art as "autocatalysis," and is thought to make polyester matrices more bulk-eroding.

Suitable aliphatic polyesters have the general formula of repeating units shown below:

Formula I

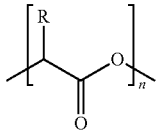

where n is an integer between 75 and 10,000 and R is selected from the group consisting of hydrogen, alkyl, aryl, alkylaryl, acetyl, heteroatoms, and mixtures thereof. In certain embodiments of the present invention wherein an aliphatic polyester is used, the aliphatic polyester may be poly(lactide). Poly(lactide) is synthesized either from lactic acid by a condensation reaction or, more commonly, by ring-opening polymerization of cyclic lactide monomer. Since both lactic acid and lactide can achieve the same repeating unit, the general term poly(lactic acid) as used herein refers to writ of formula I without any limitation as to how the polymer was made (e.g., from lactides, lactic acid, or oligomers), and without reference to the degree of polymerization or level of plasticization.

The lactide monomer exists generally in three different forms: two stereoisomers (L- and D-lactide) and racemic D,L-lactide (meso-lactide). The oligomers of lactic acid and the oligomers of lactide are defined by the formula:

Formula II

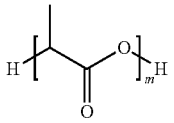

where m is an integer in the range of from greater than or equal to about 2 to less than or equal to about 75. In certain embodiments, m may be an integer in the range of from greater than or equal to about 2 to less than or equal to about 10. These limits may correspond to number average molecular weights below about 5,400 and below about 720, respectively. The chirality of the lactide units provides a means to adjust, inter alia, degradation rates, as well as physical and mechanical properties. Poly(L-lactide), for instance, is a semicrystalline polymer with a relatively slow hydrolysis rate. This could be desirable in applications of the present invention in which a slower degradation of the degradable material is desired. Poly(D,L-lactide) may be a more amorphous polymer with a resultant faster hydrolysis rate. This may be suitable for other applications in which a more rapid degradation may be appropriate. The stereoisomers of lactic acid may be used individually, or may be combined in accordance with the present invention. Additionally, they may be copolymerized with, for example, glycolide or other monomers like ε-caprolactone, 1,5-dioxepan-2-one, trimethylene carbonate, or other suitable monomers to obtain polymers with different properties or degradation times. Additionally, the lactic acid stereoisomers can be modified by blending high and low molecular weight polylactide or by blending polylactide with other polyesters. In embodiments wherein polylactide is used as the degradable material, certain preferred embodiments employ a mixture of the D and L stereoisomers, designed so as to provide a desired degradation time and/or rate. Examples of suitable sources of degradable material are commercially available 6250D™ (poly(lactic acid), available from Cargill Dow) and 5639A™ (poly(lactic acid), available from Cargill Dow).

Aliphatic polyesters useful in the present invention may be prepared by substantially any of the conventionally known manufacturing methods such as those described in U.S. Pat. Nos. 2,703,316; 3,912,692; 4,387,769; 5,216,050; and 6,323,307, the relevant disclosures of which are incorporated herein by reference.

Polyanhydrides are another type of degradable polymer that may be suitable for use in the present invention. Polyanhydride hydrolysis proceeds, inter alia, via free carboxylic acid chain-ends to yield carboxylic acids as final degradation products. Their erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

The physical properties of degradable polymers may depend on several factors including, but not limited to, the composition of the repeat units, flexibility of the chain, presence of polar groups, molecular mass, degree of branching, crystallinity, and orientation. For example, short chain branches may reduce the degree of crystallinity of polymers while long chain branches may lower the melt viscosity and may impart, inter alia, extensional viscosity with tension-stiffening behavior. The properties of the material utilized further may be tailored by blending, and copolymerizing it with another polymer, or by a change in the macromolecular architecture (e.g., hyper-branched polymers, star-shaped, or dendrimers, and the like). The properties of any such suitable degradable polymers (e.g., hydrophobicity, hydrophilicity, rate of degradation, and the like) can be tailored by introducing select functional groups along the polymer chains. For example, poly(phenyllactide) will degrade at about one-fifth of the rate of racemic poly(lactide) at a pH of 7.4 at 55° C. One of ordinary skill in the art, with the benefit of this disclosure, will be able to determine the appropriate functional groups to introduce to the polymer chains to achieve the desired physical properties of the degradable polymers.

Suitable dehydrated compounds for use as solid particulates in the present invention may degrade over time as they are rehydrated. For example, a particulate solid anhydrous borate material that degrades over time may be suitable for use in the present invention. Specific examples of particulate solid anhydrous borate materials that may be used include, but are not limited to, anhydrous sodium tetraborate (also known as anhydrous borax) and anhydrous boric acid.

Whichever degradable material is used in the present invention, the degradable material may have any shape, including, but not limited to, particles having the physical shape of platelets, shavings, flakes, ribbons, rods, strips, spheroids, toroids, pellets, tablets, or any other physical shape. In certain embodiments of the present invention, the degradable material used may comprise a mixture of fibers and spherical particles. One of ordinary skill in the art, with the benefit of this disclosure, will recognize the specific degradable material that may be used in accordance with the present invention, and the preferred size and shape for a given application.

In choosing the appropriate degradable material, one should consider the degradation products that will result, and choose a degradable material that will not yield degradation products that would adversely affect other operations or components utilized in that particular application. The choice of degradable material also may depend, at least in part, on the conditions of the well (e.g., wellbore temperature). For instance, lactides have been found to be suitable for lower temperature wells, including those within the range of 60° F. to 150° F., and polylactides have been found to be suitable for wellbore temperatures above this range.

In certain embodiments, the degradation of the degradable material could result in a final degradation product having the potential to affect the pH of the self-degrading cement compositions utilized in the methods of the present invention. In certain embodiments, a buffer compound may be included within the self-degrading cement compositions utilized in the methods of the present invention in an amount sufficient to neutralize the final degradation product. Examples of suitable buffer compounds include, but are not limited to, calcium carbonate, magnesium oxide, ammonium acetate, and the like. An example of a suitable buffer compound comprises commercially available BA-20™ (ammonium acetate, available from Halliburton Energy Services, Inc.).

In some embodiments, a treatment fluid may be foamed or a wet gas. Foamed fluids and wet gases may minimize the exposure of the subterranean formation to aqueous-based fluid, which for some tight formations like shale advantageously minimize the deleterious effects water has on the formation faces (e.g., clay swelling). Foamed fluids and wet gases may also, in some embodiments, be capable of suspending the small propping agents because of their size.

In some embodiments, a treatment fluid may comprise an aqueous base fluid, a gas, a foaming agent, and optionally depending on the treatment fluid small propping agents, large propping agents, or no propping agents. In some embodiments, the base fluid, gas, and/or foaming agent may vary for the treatment fluids of the different steps described above. In such embodiments, one skilled in the art should understand that a pill may optionally need to be inserted between steps to properly change treatment fluids.

Aqueous base fluids suitable for use in the treatment fluids of the present invention may comprise fresh water, saltwater (e.g., water containing one or more salts dissolved therein), brine (e.g., saturated salt water or produced water), seawater, produced water (e.g., water produced from a subterranean formation) or combinations thereof. Generally, the water may be from any source, provided that it does not contain components that might adversely affect the stability and/or performance of the first treatment fluids or second treatment fluids of the present invention. In certain embodiments, the density of the aqueous base fluid can be adjusted, among other purposes, to provide additional particulate transport and suspension in the treatment fluids used in the methods of the present invention. In certain embodiments, the pH of the aqueous base fluid may be adjusted (e.g., by a buffer or other pH adjusting agent), among other purposes, to activate a crosslinking agent and/or to reduce the viscosity of the first treatment fluid (e.g., activate a breaker, deactivate a crosslinking agent). In these embodiments, the pH may be adjusted to a specific level, which may depend on, among other factors, the types of gelling agents, acids, and other additives included in the treatment fluid. One of ordinary skill in the art, with the benefit of this disclosure, will recognize when such density and/or pH adjustments are appropriate.

A gas suitable for use in conjunction with the present invention may include, but is not limited to, nitrogen, carbon dioxide, air, methane, helium, argon, and any combination thereof. One skilled in the art, with the benefit of this disclosure, should understand the benefit of each gas. By way of nonlimiting example, carbon dioxide foams may have deeper well capability than nitrogen foams because carbon dioxide emulsions have greater density than nitrogen gas foams so that the surface pumping pressure required to reach a corresponding depth is lower with carbon dioxide than with nitrogen. Moreover, the higher density may impart greater proppant transport capability, up to about 12 lb of proppant per gal of fracture fluid.

In some embodiments, the quality of the foamed treatment fluid may range from a lower limit of about 5%, 10%, 25%, 40%, 50%, 60%, or 70% gas volume to an upper limit of about 95%, 90%, 80%, 75%, 60%, or 50% gas volume, and wherein the quality of the foamed treatment fluid may range from any lower limit to any upper limit and encompass any subset therebetween. Most preferably, the foamed treatment fluid may have a foam quality from about 85% to about 95%, or about 92% to about 95%.

Suitable foaming agents for use in conjunction with the present invention may include, but are not limited to, cationic foaming agents, anionic foaming agents, amphoteric foaming agents, nonionic foaming agents, or any combination thereof. Nonlimiting examples of suitable foaming agents may include, but are not limited to, surfactants like betaines, sulfated or sulfonated alkoxylates, alkyl quarternary amines, alkoxylated linear alcohols, alkyl sulfonates, alkyl aryl sulfonates, $C_{10}$-$C_{20}$ alkyldiphenyl ether sulfonates, polyethylene glycols, ethers of alkylated phenol, sodium dodecylsulfate, alpha olefin sulfonates such as sodium dodecane sulfonate, trimethyl hexadecyl ammonium bromide, and the like, any derivative thereof, or any combination thereof. Foaming agents may be included in foamed treatment fluids at concentrations ranging typically from about 0.05 to about 2 percent of the liquid component by weight (e.g., from about 0.5 to about 20 gallons per 1000 gallons of liquid).

In some embodiments, a treatment fluid may comprise a base fluid selected from an oil-based fluid, an aqueous-based fluid, a water-in-oil emulsion, or an oil-in-water emulsion and optionally, depending on the treatment fluid, small propping agents, large propping agents, or no propping agents. In some embodiments, the base fluid may vary for the different steps described above. In such embodiments, one skilled in the art should understand that a pill may optionally need to be inserted between steps to properly change base fluids.

Suitable oil-based fluids may include alkanes, olefins, aromatic organic compounds, cyclic alkanes, paraffins, diesel fluids, mineral oils, desulfurized hydrogenated kerosenes, and any combination thereof. Suitable aqueous-based fluids may include those listed above. Suitable aqueous-miscible fluids may include, but not be limited to, alcohols, e.g., methanol, ethanol, n-propanol, isopropanol, n-butanol, sec-butanol, isobutanol, and t-butanol; glycerins; glycols, e.g., polyglycols, propylene glycol, and ethylene glycol; polyglycol amines; polyols; any derivative thereof; any in combination with salts, e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate; any in combination with an aqueous-based fluid, and any combination thereof. Suitable water-in-oil emulsions, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base treatment fluid, where the amount may range from any lower limit to any upper limit and encompass any subset therebetween. Examples of suitable invert emulsions include those disclosed in U.S. Pat. No. 5,905,061, U.S. Pat. No. 5,977,031, and U.S. Pat. No. 6,828,279, each of which are incorporated herein by reference. It should be noted that for water-in-oil and oil-in-water emulsions, any mixture of the above may be used including the water being and/or comprising an aqueous-miscible fluid.

In some embodiments, a treatment fluid for use in the present invention may further comprise an additive including, but not limited to, salts, weighting agents, inert solids, fluid loss control agents, emulsifiers, dispersion aids, corrosion inhibitors, emulsion thinners, emulsion thickeners, viscosifying agents, surfactants, particulates, lost circulation materials, foaming agents, gases, pH control additives, breakers, biocides, crosslinkers, stabilizers, chelating agents, scale inhibitors, mutual solvents, oxidizers, reducers, friction reducers, clay stabilizing agents, and any combination thereof. In some embodiments, it may be advantageous to include clay stabilizing agents in the treatment fluids so as to minimize clay swelling, especially if the treatment fluid comprises an aqueous fluid.

Further, one skilled in the art, with the benefit of this disclosure should understand that compatibility with the gas of foamed fluids should be taken into consideration when choosing the concentration and composition of additives. By way of nonlimiting example, carbon dioxide is acidic so that crosslinking agents compatible with carbon dioxide foams are generally limited to those active in the pH range of about 3 to about 5. Of the common crosslinkers this excludes borates from use with carbon dioxide because borates are not effective below a pH of about 8.

In some embodiments, small propping agents and/or large propping agents may be coated with a consolidating agent. As used herein, the term "coating," and the like, does not imply any particular degree of coating on the particulate. In particular, the terms "coat" or "coating" do not imply 100% coverage by the coating on the particulate. In some embodiments, small propping agents and/or large propping agents may be coated with a consolidating agent prior to introduction into a wellbore, after introduction into a wellbore, simultaneous to introduction into a wellbore, or any combination thereof.

Consolidating agents suitable for use in the methods of the present invention generally comprise any compound that is capable of minimizing particulate migration. Nonlimiting examples of consolidating agents include SANDWEDGE® (an adhesive substance, available from Halliburton Energy Services, Inc.) and EXPEDITE® (a two-component resin system, available from Halliburton Energy Services, Inc.). In some embodiments, the consolidating agent may comprise a consolidating agent selected from the group consisting of: non-aqueous tackifying agents; aqueous tackifying agents; resins; silyl-modified polyamide compounds; crosslinkable aqueous polymer compositions; and consolidating agent emulsions. Mixtures, combinations, and/or derivatives of these also may be suitable. The type and amount of consolidating agent included in a particular method of the present invention may depend upon, among other factors, the composition and/or temperature of the subterranean formation, the chemical composition of formation fluids, the flow rate of fluids present in the formation, the effective porosity and/or permeability of the subterranean formation, pore throat size and distribution, and the like. Furthermore, the concentration of the consolidating agent can be varied, inter alia, to either enhance bridging to provide for a more rapid coating of the consolidating agent or to minimize bridging to allow deeper penetration into the subterranean formation. It is within the ability of one skilled in the art, with the benefit of this disclosure, to determine the type and amount of consolidating agent to include in the methods of the present invention to achieve the desired results.

In some embodiments, the consolidating agent may comprise a consolidating agent emulsion that comprises an aqueous fluid, an emulsifying agent, and a consolidating agent. The consolidating agent in suitable emulsions may be either a non-aqueous tackifying agent or a resin. These consolidating agent emulsions have an aqueous external phase and organic-based internal phase. The term "emulsion" and any derivatives thereof as used herein refers to a combination of two or more immiscible phases and includes, but is not limited to, dispersions and suspensions.

Suitable consolidating agent emulsions comprise an aqueous external phase comprising an aqueous fluid. Suitable aqueous fluids that may be used in the consolidating agent emulsions of the present invention include freshwater, salt water, brine, seawater, or any other aqueous fluid that, preferably, does not adversely react with the other components used in accordance with this invention or with the subterranean formation. One should note, however, that if long-term stability of the emulsion is desired, a more suitable aqueous fluid may be one that is substantially free of salts. It is within the ability of one skilled in the art, with the benefit of this disclosure, to determine if and how much salt may be tolerated in the consolidating agent emulsions of the present invention before it becomes problematic for the stability of the emulsion. The aqueous fluid may be present in the consolidating agent emulsions in an amount in the range of about 20% to 99.9% by weight of the consolidating agent emulsion composition. In some embodiments, the aqueous fluid may be present in the consolidating agent emulsions in an amount in the range of about 60% to 99.9% by weight of the consolidating agent emulsion composition. In some embodiments, the aqueous fluid may be present in the consolidating agent emulsions in an amount in the range of about 95% to 99.9% by weight of the consolidating agent emulsion composition.

The consolidating agent in the emulsion may be either a non-aqueous tackifying agent or a resin. The consolidating agents may be present in a consolidating agent emulsion in an amount in the range of about 0.1% to about 80% by weight of the consolidating agent emulsion composition. In some embodiments, the consolidating agent may be present in a consolidating agent emulsion in an amount in the range of about 0.1% to about 40% by weight of the composition. In some embodiments, the consolidating agent may be present in a consolidating agent emulsion in an amount in the range of about 0.1% to about 5% by weight of the composition.

As previously stated, the consolidating agent emulsions comprise an emulsifying agent. Examples of suitable emulsifying agents may include surfactants, proteins, hydrolyzed proteins, lipids, glycolipids, and nanosized particulates, including, but not limited to, fumed silica. Combinations of these may be suitable as well.

In some embodiments of the present invention, the consolidating agent may comprise a non-aqueous tackifying agent. A particularly preferred group of non-aqueous tackifying agents comprises polyamides that are liquids or in solution at the temperature of the subterranean formation such that they are, by themselves, non-hardening when introduced into the subterranean formation. A particularly preferred product is a condensation reaction product comprised of a commercially available polyacid and a polyamine. Such commercial products include compounds such as combinations of dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Combinations of these may be suitable as well.

Additional compounds which may be used as non-aqueous tackifying agents include liquids and solutions of, for example, polyesters, polycarbonates, silyl-modified polyamide compounds, polycarbamates, urethanes, natural resins such as shellac, and the like. Combinations of these may be suitable as well.

Other suitable non-aqueous tackifying agents are described in U.S. Pat. Nos. 5,853,048 and 5,833,000, and U.S. Patent Publication Numbers 2007/0131425 and 2007/0131422, the relevant disclosures of which are herein incorporated by reference.

Non-aqueous tackifying agents suitable for use in the present invention may either be used such that they form a non-hardening coating on a surface or they may be combined with a multifunctional material capable of reacting with the non-aqueous tackifying agent to form a hardened coating. A "hardened coating" as used herein means that the reaction of the tackifying compound with the multifunctional material should result in a substantially non-flowable reaction product that exhibits a higher compressive strength in a consolidated agglomerate than the tackifying compound alone with the particulates. In this instance, the non-aqueous tackifying agent may function similarly to a hardenable resin.

Multifunctional materials suitable for use in the present invention include, but are not limited to, aldehydes; dialdehydes such as glutaraldehyde; hemiacetals or aldehyde releasing compounds; diacid halides; dihalides such as dichlorides and dibromides; polyacid anhydrides; epoxides; furfuraldehyde; aldehyde condensates; and silyl-modified polyamide compounds; and the like; and combinations thereof. Suitable silyl-modified polyamide compounds that may be used in the present invention are those that are substantially self-hardening compositions capable of at least partially adhering to a surface or to a particulate in the unhardened state, and that are further capable of self-hardening themselves to a substantially non-tacky state to which individual particulates such as formation fines will not adhere to, for example, in formation or proppant pack pore throats. Such silyl-modified polyamides may be based, for example, on the reaction product of a silating compound with a polyamide or a combination of polyamides. The polyamide or combination of polyamides may be one or more polyamide intermediate compounds obtained, for example, from the reaction of a polyacid (e.g., diacid or higher) with a polyamine (e.g., diamine or higher) to form a polyamide polymer with the elimination of water.

In some embodiments of the present invention, the multifunctional material may be mixed with the tackifying compound in an amount of about 0.01% to about 50% by weight of the tackifying compound to effect formation of the reaction product. In other embodiments, the multifunctional material is present in an amount of about 0.5% to about 1% by weight of the tackifying compound. Suitable multifunctional materials are described in U.S. Pat. No. 5,839,510, the entire disclosure of which is herein incorporated by reference.

Aqueous tackifying agents suitable for use in the present invention are usually not generally significantly tacky when placed onto a particulate, but are capable of being "activated" (e.g., destabilized, coalesced and/or reacted) to transform the compound into a sticky, tackifying compound at a desirable time. Such activation may occur before, during, or after the aqueous tackifier agent is placed in the subterranean formation. In some embodiments, a pretreatment may be first contacted with the surface of a particulate to prepare it to be coated with an aqueous tackifier agent. Suitable aqueous tackifying agents are generally charged polymers that comprise compounds that, when in an aqueous solvent or solution, will form a non-hardening coating (by itself or with an activator) and, when placed on a particulate, will increase the continuous critical resuspension velocity of the particulate when contacted by a stream of water. The aqueous tackifier agent may enhance the grain-to-grain contact between the individual particulates within the formation (be they diverting agents, proppant particulates, formation fines, or other particulates), helping bring about the consolidation of the particulates into a cohesive, flexible, and permeable mass.

Suitable aqueous tackifying agents include any polymer that can bind, coagulate, or flocculate a particulate. Also, polymers that function as pressure-sensitive adhesives may be suitable. Examples of aqueous tackifying agents suitable for use in the present invention include, but are not limited to, acrylic acid polymers; acrylic acid ester polymers; acrylic acid derivative polymers; acrylic acid homopolymers; acrylic acid ester homopolymers (such as poly(methyl acrylate), poly(butyl acrylate), and poly(2-ethylhexyl acrylate)); acrylic acid ester co-polymers; methacrylic acid derivative polymers; methacrylic acid homopolymers; methacrylic acid ester homopolymers (such as poly(methyl methacrylate), poly(butyl methacrylate), and poly(2-ethylhexyl methacrylate)); acrylamido-methyl-propane sulfonate polymers; acrylamido-methyl-propane sulfonate derivative polymers; acrylamido-methyl-propane sulfonate co-polymers; and acrylic acid/acrylamido-methyl-propane sulfonate co-polymers; derivatives thereof, and combinations thereof. Methods of determining suitable aqueous tackifying agents and additional disclosure on aqueous tackifying agents can be found in U.S. Patent Publication Numbers 2005/0277554 and 2005/0274517, the entire disclosures of which are hereby incorporated by reference.

Some suitable tackifying agents are described in U.S. Pat. No. 5,249,627, the entire disclosure of which is incorporated herein by reference, which discloses aqueous tackifying agents that comprise at least one member selected from the group consisting of benzyl coco di-(hydroxyethyl) quaternary amine, p-T-amyl-phenol condensed with formaldehyde, and a copolymer comprising from about 80% to about 100% C1-30 alkylmethacrylate monomers and from about 0% to about 20% hydrophilic monomers. In some embodiments, the aqueous tackifying agent may comprise a copolymer that comprises from about 90% to about 99.5% 2-ethylhexylacrylate and from about 0.5% to about 10% acrylic acid. Suitable hydrophillic monomers may be any monomer that will provide polar oxygen-containing or nitrogen-containing groups. Suitable hydrophillic monomers include dialkyl amino alkyl (meth)acrylates and their quaternary addition and acid salts, acrylamide, N-(dialkyl amino alkyl) acrylamide, methacrylamides and their quaternary addition and acid salts, hydroxy alkyl (meth)acrylates, unsaturated carboxylic acids such as methacrylic acid or acrylic acid, hydroxyethyl acrylate, acrylamide, and the like. Combinations of these may be suitable as well. These copolymers can be made by any suitable emulsion polymerization technique. Methods of producing these copolymers are disclosed, for example, in U.S. Pat. No. 4,670,501, the entire disclosure of which is incorporated herein by reference.

In some embodiments of the present invention, the consolidating agent may comprise a resin. The term "resin" as used herein refers to any of numerous physically similar polymerized synthetics or chemically modified natural resins including thermoplastic materials and thermosetting materials. Resins that may be suitable for use in the present invention may include substantially all resins known and used in the art.

Many such resins are commonly used in subterranean consolidation operations, and some suitable resins may include, but are not limited to, two-component epoxy-based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, or any combination thereof. Some suitable resins, such as epoxy resins, may be cured with an internal catalyst or activator so that when pumped down hole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the present invention and to determine whether a catalyst is required to trigger curing.

Selection of a suitable resin may be affected by the temperature of the subterranean formation to which the fluid will be introduced. By way of example, for subterranean formations having a bottom hole static temperature ("BHST") ranging from about 60° F. to about 250° F., two-component epoxy-based resins comprising a hardenable resin component and a hardening agent component containing specific hardening agents may be preferred. For subterranean formations having a BHST ranging from about 300° F. to about 600° F., a furan-based resin may be preferred. For subterranean formations having a BHST ranging from about 200° F. to about 400° F., either a phenolic-based resin or a one-component HT epoxy-based resin may be suitable. For subterranean formations having a BHST of at least about 175° F., a phenol/phenol formaldehyde/furfuryl alcohol resin may also be suitable.

One type of resin suitable for use in the methods of the present invention is a two-component epoxy-based resin comprising a liquid hardenable resin component and a liquid hardening agent component. The liquid hardenable resin component comprises a hardenable resin and an optional solvent. The solvent may be added to the resin to reduce its viscosity for ease of handling, mixing and transferring. It is within the ability of one skilled in the art, with the benefit of this disclosure, to determine if and how much solvent may be needed to achieve a viscosity suitable to the subterranean conditions. Factors that may affect this decision include geographic location of the well, the surrounding weather conditions, and the desired long-term stability of the consolidating agent. An alternate way to reduce the viscosity of the hardenable resin is to heat it. The second component is the liquid hardening agent component, which comprises a hardening agent, an optional silane coupling agent, a surfactant, an optional hydrolyzable ester for, among other things, breaking gelled fracturing fluid films on particulates, and an optional liquid carrier fluid for, among other things, reducing the viscosity of the hardening agent component.

Examples of hardenable resins that can be used in the liquid hardenable resin component include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and combinations thereof. In some embodiments, the hardenable resin may comprise a urethane resin. Examples of suitable urethane resins may comprise a polyisocyanate component and a polyhydroxy component. Examples of suitable hardenable resins, including urethane resins, that may be suitable for use in the methods of the present invention include those described in U.S. Pat. Nos. 4,585,064; 6,582,819; 6,677,426; and 7,153,575, the entire disclosures of which are herein incorporated by reference.

The hardenable resin may be included in the liquid hardenable resin component in an amount in the range of about 5% to about 100% by weight of the liquid hardenable resin component. It is within the ability of one skilled in the art, with the benefit of this disclosure, to determine how much of the liquid hardenable resin component may be needed to achieve the desired results. Factors that may affect this decision include which type of liquid hardenable resin component and liquid hardening agent component are used.

Any solvent that is compatible with the hardenable resin and achieves the desired viscosity effect may be suitable for use in the liquid hardenable resin component. Suitable solvents may include butyl lactate, dipropylene glycol methyl ether, dipropylene glycol dimethyl ether, dimethyl formamide, diethyleneglycol methyl ether, ethyleneglycol butyl ether, diethyleneglycol butyl ether, propylene carbonate, methanol, butyl alcohol, d'limonene, fatty acid methyl esters, and butylglycidyl ether, and combinations thereof. Other preferred solvents may include aqueous dissolvable solvents such as methanol, isopropanol, butanol, and glycol ether solvents, and combinations thereof. Suitable glycol ether solvents include, but are not limited to, diethylene glycol methyl ether, dipropylene glycol methyl ether, 2-butoxy ethanol, ethers of a C2 to C6 dihydric alkanol containing at least one C1 to C6 alkyl group, mono ethers of dihydric alkanols, methoxypropanol, butoxyethanol, and hexoxyethanol, and isomers thereof. Selection of an appropriate solvent is dependent on the resin composition chosen and is within the ability of one skilled in the art, with the benefit of this disclosure.

As described above, use of a solvent in the liquid hardenable resin component is optional but may be desirable to reduce the viscosity of the hardenable resin component for ease of handling, mixing, and transferring. However, as previously stated, it may be desirable in some embodiments to not use such a solvent for environmental or safety reasons. It is within the ability of one skilled in the art, with the benefit of this disclosure, to determine if and how much solvent is needed to achieve a suitable viscosity. In some embodiments, the amount of the solvent used in the liquid hardenable resin component may be in the range of about 0.1% to about 30% by weight of the liquid hardenable resin component. Optionally, the liquid hardenable resin component may be heated to reduce its viscosity, in place of, or in addition to, using a solvent.

Examples of the hardening agents that can be used in the liquid hardening agent component include, but are not limited to, cyclo-aliphatic amines, such as piperazine, derivatives of piperazine (e.g., aminoethylpiperazine) and modified piperazines; aromatic amines, such as methylene dianiline, derivatives of methylene dianiline and hydrogenated forms, and 4,4'-diaminodiphenyl sulfone; aliphatic amines, such as ethylene diamine, diethylene triamine, triethylene tetraamine, and tetraethylene pentaamine; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; and 2-ethyl-4-methyl imidazole; and combinations thereof. The chosen hardening agent often effects the range of temperatures over which a hardenable resin is able to cure. By way of example, and not of limitation, in subterranean formations having a temperature of about 60° F. to about 250° F., amines and cyclo-aliphatic amines such as piperidine, triethylamine, tris(dimethylaminomethyl) phenol, and dimethylaminomethyl) phenol may be preferred. In subterranean formations having higher temperatures, 4,4'-diaminodiphenyl sulfone may be a suitable hardening agent. Hardening agents that comprise piperazine or a derivative of piperazine have been shown capable of curing various hardenable resins from temperatures as low as about 50° F. to as high as about 350° F.

The hardening agent used may be included in the liquid hardening agent component in an amount sufficient to at least partially harden the resin composition. In some embodiments of the present invention, the hardening agent used is included in the liquid hardening agent component in the range of about 0.1% to about 95% by weight of the liquid hardening agent component. In other embodiments, the hardening agent used may be included in the liquid hardening agent component in an amount of about 15% to about 85% by weight of the liquid hardening agent component. In other embodiments, the hardening agent used may be included in the liquid hardening agent component in an amount of about 15% to about 55% by weight of the liquid hardening agent component.

In some embodiments, the consolidating agent may comprise a liquid hardenable resin component emulsified in a liquid hardening agent component, wherein the liquid hardenable resin component is the internal phase of the emulsion and the liquid hardening agent component is the external phase of the emulsion. In other embodiments, the liquid hardenable resin component may be emulsified in water and the liquid hardening agent component may be present in the water. In other embodiments, the liquid hardenable resin component may be emulsified in water and the liquid hardening agent component may be provided separately. Similarly, in other embodiments, both the liquid hardenable resin component and the liquid hardening agent component may both be emulsified in water.

The optional silane coupling agent may be used, among other things, to act as a mediator to help bond the resin to particulates. Examples of suitable silane coupling agents include, but are not limited to, N-2-(aminoethyl)-3-aminopropyltrimethoxysilane, and 3-glycidoxypropyltrimethoxysilane, and combinations thereof. The silane coupling agent may be included in the resin component or the liquid hardening agent component (according to the chemistry of the particular group as determined by one skilled in the art with the benefit of this disclosure). In some embodiments of the present invention, the silane coupling agent used is included in the liquid hardening agent component in the range of about 0.1% to about 3% by weight of the liquid hardening agent component.

Any surfactant compatible with the hardening agent and capable of facilitating the coating of the resin onto particulates in the subterranean formation may be used in the liquid hardening agent component. Such surfactants include, but are not limited to, an alkyl phosphonate surfactant (e.g., a C12-C22 alkyl phosphonate surfactant), an ethoxylated nonyl phenol phosphate ester, one or more cationic surfactants, and one or more nonionic surfactants. Combinations of one or more cationic and nonionic surfactants also may be suitable. Examples of such surfactant combinations are described in U.S. Pat. No. 6,311,773, the relevant disclosure of which is incorporated herein by reference. The surfactant or surfactants that may be used are included in the liquid hardening agent component in an amount in the range of about 1% to about 10% by weight of the liquid hardening agent component.

While not required, examples of hydrolyzable esters that may be used in the liquid hardening agent component include, but are not limited to, a combination of dimethylglutarate, dimethyladipate, and dimethylsuccinate; dimethylthiolate; methyl salicylate; dimethyl salicylate; and dimethylsuccinate; and combinations thereof. When used, a hydrolyzable ester is included in the liquid hardening agent component in an amount in the range of about 0.1% to about 3% by weight of the liquid hardening agent component. In some embodiments a hydrolyzable ester is included in the liquid hardening agent component in an amount in the range of about 1% to about 2.5% by weight of the liquid hardening agent component.

Use of a diluent or liquid carrier fluid in the liquid hardening agent component is optional and may be used to reduce the viscosity of the liquid hardening agent component for ease of handling, mixing, and transferring. As previously stated, it may be desirable in some embodiments to not use such a solvent for environmental or safety reasons. Any suitable carrier fluid that is compatible with the liquid hardening agent component and achieves the desired viscosity effects is suitable for use in the present invention. Some suitable liquid carrier fluids are those having high flash points (e.g., about 125° F.) because of, among other things, environmental and safety concerns; such solvents include, but are not limited to, butyl lactate, dipropylene glycol methyl ether, dipropylene glycol dimethyl ether, dimethyl formamide, diethyleneglycol methyl ether, ethyleneglycol butyl ether, diethyleneglycol butyl ether, propylene carbonate, methanol, butyl alcohol, d'limonene, and fatty acid methyl esters, and combinations thereof. Other suitable liquid carrier fluids include aqueous dissolvable solvents such as, for example, methanol, isopropanol, butanol, glycol ether solvents, and combinations thereof. Suitable glycol ether liquid carrier fluids include, but are not limited to, diethylene glycol methyl ether, dipropylene glycol methyl ether, 2-butoxy ethanol, ethers of a C2 to C6 dihydric alkanol having at least one C1 to C6 alkyl group, mono ethers of dihydric alkanols, methoxypropanol, butoxyethanol, and hexoxyethanol, and isomers thereof. Combinations of these may be suitable as well. Selection of an appropriate liquid carrier fluid is dependent on, inter alia, the resin composition chosen.

Other resins suitable for use in the present invention are furan-based resins. Suitable furan-based resins include, but are not limited to, furfuryl alcohol resins, furfural resins, combinations of furfuryl alcohol resins and aldehydes, and a combination of furan resins and phenolic resins. Of these, furfuryl alcohol resins may be preferred. A furan-based resin may be combined with a solvent to control viscosity if desired. Suitable solvents for use in the furan-based consolidation fluids of the present invention include, but are not limited to, 2-butoxy ethanol, butyl lactate, butyl acetate, tetrahydrofurfuryl methacrylate, tetrahydrofurfuryl acrylate, esters of oxalic, maleic and succinic acids, and furfuryl acetate. Of these, 2-butoxy ethanol is preferred. In some embodiments, the furan-based resins suitable for use in the present invention may be capable of enduring temperatures well in excess of 350° F. without degrading. In some embodiments, the furan-based resins suitable for use in the present invention are capable of enduring temperatures up to about 700° F. without degrading.

Optionally, the furan-based resins suitable for use in the present invention may further comprise a curing agent to facilitate or accelerate curing of the furan-based resin at lower temperatures. The presence of a curing agent may be particularly useful in embodiments where the furan-based resin may be placed within subterranean formations having temperatures below about 350° F. Examples of suitable curing agents include, but are not limited to, organic or inorganic acids, such as, inter alia, maleic acid, fumaric acid, sodium bisulfate, hydrochloric acid, hydrofluoric acid, acetic acid, formic acid, phosphoric acid, sulfonic acid, alkyl benzene sulfonic acids such as toluene sulfonic acid and dodecyl benzene sulfonic acid ("DDBSA"), and combinations thereof. In those embodiments where a curing agent is not used, the furan-based resin may cure autocatalytically.

Still other resins suitable for use in the methods of the present invention are phenolic-based resins. Suitable phenolic-based resins include, but are not limited to, terpolymers of phenol, phenolic formaldehyde resins, and a combination of phenolic and furan resins. In some embodiments, a combination of phenolic and furan resins may be preferred. A phenolic-based resin may be combined with a solvent to control viscosity if desired. Suitable solvents for use in the present invention include, but are not limited to, butyl acetate, butyl lactate, furfuryl acetate, and 2-butoxy ethanol. Of these, 2-butoxy ethanol may be preferred in some embodiments.

Yet another resin-type material suitable for use in the methods of the present invention is a phenol/phenol formaldehyde/furfuryl alcohol resin comprising of about 5% to about 30% phenol, of about 40% to about 70% phenol formaldehyde, of about 10% to about 40% furfuryl alcohol, of about 0.1% to about 3% of a silane coupling agent, and of about 1% to about 15% of a surfactant. In the phenol/phenol formaldehyde/furfuryl alcohol resins suitable for use in the methods of the present invention, suitable silane coupling agents include, but are not limited to, N-2-(aminoethyl)-3-aminopropyltrimethoxysilane, and 3-glycidoxypropyltrimethoxysilane. Suitable surfactants include, but are not limited to, an ethoxylated nonyl phenol phosphate ester, combinations of one or more cationic surfactants, and one or more nonionic surfactants and an alkyl phosphonate surfactant.

In some embodiments, resins suitable for use in the consolidating agent emulsion compositions of the present invention may optionally comprise filler particles. Suitable filler particles may include any particle that does not adversely react with the other components used in accordance with this invention or with the subterranean formation. Examples of suitable filler particles include silica, glass, clay, alumina, fumed silica, carbon black, graphite, mica, meta-silicate, calcium silicate, calcine, kaoline, talc, zirconia, titanium dioxide, fly ash, and boron, and combinations thereof. In some embodiments, the filler particles may range in size of about 0.01 μm to about 100 μm. As will be understood by one skilled in the art, particles of smaller average size may be particularly useful in situations where it is desirable to obtain high proppant pack permeability (i.e., conductivity), and/or high consolidation strength. In certain embodiments, the filler particles may be included in the resin composition in an amount of about 0.1% to about 70% by weight of the resin composition. In other embodiments, the filler particles may be included in the resin composition in an amount of about 0.5% to about 40% by weight of the resin composition. In some embodiments, the filler particles may be included in the resin composition in an amount of about 1% to about 10% by weight of the resin composition. Some examples of suitable resin compositions comprising filler particles are described in U.S. Patent Publication Number 2008/0006405, the entire disclosure of which is herein incorporated by reference.

Silyl-modified polyamide compounds may be described as substantially self-hardening compositions that are capable of at least partially adhering to particulates in the unhardened state, and that are further capable of self-hardening themselves to a substantially non-tacky state to which individual particulates such as formation fines will not adhere to, for example, in formation or proppant pack pore throats. Such silyl-modified polyamides may be based, for example, on the reaction product of a silating compound with a polyamide or a combination of polyamides. The polyamide or combination of polyamides may be one or more polyamide intermediate compounds obtained, for example, from the reaction of a polyacid (e.g., diacid or higher) with a polyamine (e.g., diamine or higher) to form a polyamide polymer with the elimination of water. Other suitable silyl-modified polyamides and methods of making such compounds are described in U.S. Pat. No. 6,439,309, the relevant disclosure of which is herein incorporated by reference.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

introducing a first treatment fluid comprising a first base fluid and a first propping agent having a mean particulate size in the range of from about 0.5 microns to about 20 microns into a fracture in a zone of a subterranean formation; and then introducing a second treatment fluid comprising a second base fluid and a second propping agent having a mean particulate size in the range of greater than about 35 microns into the fracture.

2. The method of claim 1 further comprising:

introducing a third treatment fluid into the subterranean formation at a pressure sufficient to create or extend at least a portion of a fracture, wherein introduction of the first treatment fluid and the second treatment fluid occur after at least a portion of the fracture is formed.

3. The method of claim 1, wherein the first treatment fluid and/or the second treatment fluid are introduced at a pressure sufficient to create or extend at least a portion of the fracture.

4. The method of claim 1, wherein the first treatment fluid and/or the second treatment fluid is foamed.

5. The method of claim 1, wherein the first treatment fluid and/or the second treatment fluid is a wet gas.

6. The method of claim 1 further comprising:

atomizing the first propping agent into a flow stream comprising the first base fluid before introducing the first treatment fluid into the fracture.

7. The method of claim 1, wherein the second propping agent comprises a coating that comprises a consolidating agent.

8. The method of claim 1, wherein the second propping agent is at least partially degradable.

9. The method of claim 1 further comprising:

repeating the steps of introducing the first treatment fluid and introducing the second treatment fluid successively in the fracture.

10. The method of claim 1 further comprising:

repeating the steps of introducing the first treatment fluid and introducing the second treatment fluid successively in a fracture of a second zone of the subterranean formation.

11. The method of claim 1 further comprising:

repeating the steps of introducing the first treatment fluid and then introducing the second treatment fluid in at least a second zone extending from a second wellbore near the wellbore such that the second zone comprises a second fracture that is in close proximity to the first fracture such that formation stress caused by propping one of the first fracture impacts a structure of the second fracture.

12. A method comprising the following steps in order:

isolating a first zone extending from a wellbore in a subterranean formation, the first zone comprising a first fracture;

introducing a first treatment fluid comprising a first base fluid and a first propping agent having a mean particulate size in the range of from about 0.5 microns to about 20 microns into the first fracture;

introducing a second treatment fluid comprising a second base fluid and a second propping agent having a mean particulate size in the range of greater than about 35 microns into the first fracture;

isolating a second zone extending from the wellbore in the subterranean formation, the second zone comprising a second fracture;

introducing a third treatment fluid comprising a third base fluid and a third propping agent having a mean particulate size in the range of from about 0.5 microns to about 20 microns into the second fracture; and introducing a fourth treatment fluid comprising a fourth base fluid and a fourth propping agent having a mean particulate size in the range of greater than about 35 microns into the second fracture.

13. The method of claim 12, wherein the first fracture and the second fracture are connected.

14. The method of claim 12, wherein the first treatment fluid and/or the third treatment fluid is foamed.

15. The method of claim 12, wherein the first treatment fluid and/or the third treatment fluid is a wet gas.

16. The method of claim 12 further comprising:

atomizing the first propping agent into a flow stream comprising the first base fluid before introducing the first treatment fluid into the fracture.

17. A method comprising the following steps in order:

isolating a first zone extending from a wellbore in a subterranean formation;

introducing a first treatment fluid into the first zone of the subterranean formation at a pressure sufficient to create or extend at least a portion of a first fracture in the first zone;

introducing a second treatment fluid comprising a first base fluid and a first propping agent having a mean particulate size in the range of from about 0.5 microns to about 20 microns into the first fracture; and introducing a third treatment fluid comprising a second base fluid and a second propping agent having a mean particulate size in the range of greater than about 35 microns into the first fracture.

18. The method of claim 17 further comprising the following steps in order after introducing the third treatment fluid:

isolating a second zone extending from the wellbore in the subterranean formation, the second zone comprising a second fracture;

introducing a fourth treatment fluid comprising a third base fluid and a third propping agent having a mean particulate size in the range of from about 0.5 microns to about 20 microns into the second fracture network; and introducing a fifth treatment fluid comprising a fourth base fluid and a fourth propping agent having a mean particulate size in the range of greater than about 35 microns into the second fracture network.

19. The method of claim 1, wherein the first propping agent is substantially spherical.

20. The method of claim 1, wherein the first propping agent comprises at least one selected from the group consisting of sand, bauxite, ceramic materials, fly ash, silica flour, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof.

21. The method of claim 20, wherein the composite particulates comprise a binder and filler, further wherein the filler comprises at least one selected from the group consisting of silica, alumina, fumed carbon, carbon black, graphite, mica, titanium dioxide, meta-silicate, calcium silicate, kaolin, talc, zirconia, boron, fly ash, carbon nanofibers, cellulosic nanofibers, natural and synthetic nanoclays, hollow glass microspheres, solid glass, and combinations thereof.

22. The method of claim 1, wherein the second propping agent has a mean particulate size in the range of from about 35 microns to about 800 microns.

23. The method of claim 12, wherein the first propping agent is substantially spherical.

24. The method of claim 12, wherein the first propping agent comprises at least one selected from the group consisting of sand, bauxite, ceramic materials, fly ash, silica flour, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof.

25. The method of claim 24, wherein the composite particulates comprise a binder and filler, further wherein the filler comprises at least one selected from the group consisting of silica, alumina, fumed carbon, carbon black, graphite, mica, titanium dioxide, meta-silicate, calcium silicate, kaolin, talc, zirconia, boron, fly ash, carbon nanofibers, cellulosic nanofibers, natural and synthetic nanoclays, hollow glass microspheres, solid glass, and combinations thereof.

26. The method of claim 12, wherein the second propping agent has a mean particulate size in the range of from about 35 microns to about 800 microns.

27. The method of claim 17, wherein the first propping agent is substantially spherical.

28. The method of claim 17, wherein the first propping agent comprises at least one selected from the group consisting of sand, bauxite, ceramic materials, fly ash, silica flour, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof.

29. The method of claim 28, wherein the composite particulates comprise a binder and filler, further wherein the filler comprises at least one selected from the group consisting of silica, alumina, fumed carbon, carbon black, graphite, mica, titanium dioxide, meta-silicate, calcium silicate, kaolin, talc, zirconia, boron, fly ash, carbon nanofibers, cellulosic nanofibers, natural and synthetic nanoclays, hollow glass microspheres, solid glass, and combinations thereof.

30. The method of claim 17, wherein the second propping agent has a mean particulate size in the range of from about 35 microns to about 800 microns.

* * * * *